US010858215B2

(12) United States Patent
Karl et al.

(10) Patent No.: US 10,858,215 B2
(45) Date of Patent: Dec. 8, 2020

(54) METHOD FOR COILING A COILED PRODUCT, CONTROL INSTALLATION, COMPUTER SOFTWARE PRODUCT, AND COILING MACHINE

(71) Applicant: Siemens Aktiengesellschaft, Munich (DE)

(72) Inventors: Stephan Karl, Eichstaett (DE); Bjoern Seelinger, hoechstadt (DE); Sebastian Kerling, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 346 days.

(21) Appl. No.: 15/838,584

(22) Filed: Dec. 12, 2017

(65) Prior Publication Data

US 2018/0162682 A1 Jun. 14, 2018

(30) Foreign Application Priority Data

Dec. 12, 2016 (EP) ..... 16203431

(51) Int. Cl.
*B65H 59/04* (2006.01)
*B65H 54/10* (2006.01)
(Continued)

(52) U.S. Cl.
CPC ..... *B65H 59/04* (2013.01); *B65H 54/10* (2013.01); *B65H 59/384* (2013.01);
(Continued)

(58) Field of Classification Search
CPC .... B65H 59/04; B65H 59/384; B65H 59/385; B65H 54/10; B65H 2701/37;
(Continued)

(56) References Cited

U.S. PATENT DOCUMENTS 9,962,886 B2 * 5/2018 Hatta ..... B29C 53/62
2009/0101745 A1 * 4/2009 St. Germain ..... B65H 23/048 242/417.3

(Continued)

FOREIGN PATENT DOCUMENTS

CN 201395435 Y 2/2010
CN 102360930 2/2012

(Continued)

OTHER PUBLICATIONS

DE 10154823 English machine translation, Sep. 14, 2006 (Year: 2006).*

(Continued)

*Primary Examiner* — William A. Rivera
(74) *Attorney, Agent, or Firm* — Cozen O'Connor

(57) ABSTRACT

A coiled product, a control installation, computer software product, a coiling machine and method for coiling a coiled product, wherein the coiling tension is settable to an envisaged coiling tension, particularly to a constant coiling tension via either a setting unit and/or a change in the respective rotational speed of either a coil body and/or a supply roll, a characterizing aspect being the equalization of the free length of the coiled product, where the free length is the spacing of the first bearing point of the coiled product on the coil body from the second bearing point of the coiled product on a deflection roller such that the free length change is equalized by the setting unit and/or by a variation of the respective rotational speed so that coiling tension of a product coiled onto the coil body can be set in a simple, rapid, and precise manner.

19 Claims, 5 Drawing Sheets

(51) Int. Cl.
*B65H 59/38* (2006.01)
*H01F 41/094* (2016.01)

(52) U.S. Cl.
CPC ..... *B65H 59/385* (2013.01); *B65H 2701/36* (2013.01); *B65H 2701/37* (2013.01); *H01F 41/094* (2016.01)

(58) Field of Classification Search
CPC .... B65H 2701/36; B65H 26/04; B65H 23/26; B65H 23/185; B65H 20/34; H01F 41/094; B21F 3/04
See application file for complete search history.

(56) References Cited

U.S. PATENT DOCUMENTS

| | | | | |
|---|---|---|---|---|
| 2010/0084501 | A1 | 4/2010 | Hoshino et al. | |
| 2011/0114781 | A1* | 5/2011 | Kimura | B65H 59/12 242/443 |
| 2013/0026278 | A1* | 1/2013 | Bitterolf | B65H 54/10 242/421 |
| 2016/0339632 | A1* | 11/2016 | Kato | B29C 53/602 |
| 2018/0236735 | A1* | 8/2018 | Nishibu | B29C 53/70 |
| 2019/0352123 | A1* | 11/2019 | Kerling | H01M 10/0409 |

FOREIGN PATENT DOCUMENTS

| | | |
|---|---|---|
| CN | 102629515 | 8/2012 |
| CN | 103354171 | 10/2013 |
| CN | 105173850 | 12/2015 |
| CN | 106115322 | 11/2016 |
| DE | 10154823 | 7/2003 |
| EP | 0926090 | 6/1999 |
| EP | 1975106 | 10/2008 |
| EP | 2306473 | 4/2011 |
| EP | 2485227 | 8/2012 |
| EP | 2617670 | 7/2013 |
| EP | 2172283 B1 | 8/2013 |
| JP | S60105210 | 6/1985 |
| JP | H 06-204071 | 7/1994 |
| JP | 2014-236092 | 12/2014 |
| WO | WO2006133662 | 12/2006 |

OTHER PUBLICATIONS

Office Action dated Aug. 9, 2019 issued in Chinese Patent Application No. 201711292046.5.
Office Action dated Feb. 14, 2019 issued in Chinese Patent Application No. 2017112920465.

* cited by examiner

METHOD FOR COILING A COILED PRODUCT, CONTROL INSTALLATION, COMPUTER SOFTWARE PRODUCT, AND COILING MACHINE

BACKGROUND OF THE INVENTION

1. Field of the Invention

The method relates to a method for coiling a coiled product, a control installation, a computer software product, and to a coiling machine.

2. Description of the Related Art

In the coiling of a coiled product, particularly in the case of a wire or of a film, onto a coil body, the coiled product is typically impinged with a coiling tension. The coiling tension herein corresponds to the force (per cross-sectional area) with which the coiled product is coiled onto the coil body. In modern devices for coiling a coiled product, the coiling tension can be set. In other words, the coiling tension is the tensile stress on the coiled product.

EP 2 485 227 A1 describes a wire coiling machine and a regulator for such a wire coiling machine.

In accordance with the present prior art, the coiling tension, in particular a non-constant coiling tension, is difficult to set.

SUMMARY OF THE INVENTION

In view of the foregoing, it is therefore an object of the invention to provide an improved method, an improved device for coiling a coiled product, and more particularly, to control the coiling tension in a coiling procedure, where the coiling tension is preferably to be set to a constant value.

This and other objects and advantages are achieved in accordance with the invention by a method, a computer software product, a control installation according and by a coiling machine having such a control installation, where in accordance with the method for coiling the coiled product, particularly for coiling wire or a film onto a coil body having a non-circular cross section, the coiled product is wound from a supply roll onto the coil body. The method comprises at least providing the coiled product from the supply roll, winding the coiled product onto the coil body, where the coiling tension of the coiled product is adjustable to an envisaged coiling tension, where for setting the coiling tension a rotational speed of the coil body and/or the supply roll is controlled or regulated, and/or where the coiling tension is set to the envisaged coiling tension by a setting unit.

The invention is based on the concept that a free length of the coiled product between the bearing points of the coiled product on the coiled product and a deflection roller from which the coiled product is wound continually changes. The change is significant in particular in the case of a coil body having a non-circular cross section.

Moreover, the invention is based on the concept that a coiled product is to be wound onto the coil body at an envisaged coiling tension that is not necessarily constant in temporal terms. However, in the case of many applications such as the coiling of a battery cell, the coiling tension is to be kept as constant as possible during the entire coiling procedure.

Here, a supply roll is understood to be an installation for storing the coiled product. In an exemplary manner, this is a wire wool or a roll onto which the foil/film has been rolled. However, the coiled product can also be present in a stacked form. The supply roll can be assigned a second rotational speed such that the supply roll provides the coiled product at a speed that is proportional to the second rotational speed.

The invention is particularly suitable for wrapping a coil body that has a non-circular cross section and/or a non-constant diameter/radius. In an exemplary manner, such a coil body is shaped so as to be elliptic or rectangular.

Battery cells or film capacitors are particularly advantageously produced by the method introduced herein.

The coiling tension is understood to be the tension of the coiled product. One possibility for defining the coiling tension is the force that acts on the coiled product perpendicularly to the cross-sectional area of the coiled product, divided by the cross-sectional area. The cross-sectional area is often constant. In this instance, the coiling tension corresponds to the force with which the coiled product "in coiling is drawn off by the rotating coil body".

The envisaged coiling tension is understood to be the coiling tension with which the coiled product is to be wound onto the coil body. The envisaged coiling tension can be represented as a function of the alignment of the coil body. In an exemplary manner, this is required when coiling wire about an angular coil body in order for a good result to be achieved.

The coiling tension is preferably proportional to the curvature of the coil body on the bearing point of the coil body. Such a proportionality is particularly advantageous in the coiling of metal wire. However, it is to be noted that the curvature of the coil body decreases by virtue of the material layers that have already been wound.

The setting unit is configured to set the coiling tension. The coiled product with the aid of the setting unit is influenced prior to being wound onto the coil body.

Alternatively or additionally to setting the coiling tension with the aid of the setting unit, the rotational speed of the coil body and/or of the supply roll can be changed. The rotational speed is set by the drives which with the aid of a control installation serve to perform the coiling procedure.

The computer software product is capable of running on a computer unit and is configured to support the method for coiling a coiled product.

The computer software program is installed and stored in the computer unit. In order to run, the computer software product is uploaded to the main memory of the computer unit and is executed by a processor. When the computer software product runs, the free length is calculated, settings for the respective actuator are calculated and provided, and/or the variables for the coiling procedure are calculated.

Calculating and providing the settings to the control installation is preferably performed in-line.

The method introduced here has a multiplicity of advantages, in particular a simple and precise setting of the coiling tension, in a short set-up time in the case of an in-line calculation of parameters for the setting unit or of the rotational speeds, the observance of a bending moment or a traction torque in the coiling process is possible in a simple manner, and a significantly more precise setting of the coiling tension as compared to the current prior art.

In principle, a second bearing point of the coiled product on the last deflection roller is pinpointed for the coiled product ahead of the coil body.

The second bearing point can be the bearing point of the coiled product on the supply roll, the bearing point of the coiled product on the deflection roller, the bearing point of the coiled product on the exit of a coiled-product accumulator, and the bearing point of the coiled product on the deflection roller of a coiling tension measuring unit or of a coiling tension feedback unit, respectively.

In the case of the deflection roller, that deflection roller from which the coiled product is guided to the coil body is preferably meant.

Caused by the non-circular cross section of the coil body, a variable free length depending on the revolution of the coil body results. The difference in the path per revolution of the coil body (alignment=360°) is to be advantageously compensated for in order to keep the coiling tension of the coiled product constant.

A coiling tension is also referred to as a web tension or a coiled product tension.

The invention is particularly based on the concept that the spacing between the bearing point of the coiled product on the coil body from the bearing point of the coiled product on a deflection roller changes in the rotation of the coil body in the coiling procedure onto a coil body having a non-circular cross section.

The change in the spacing between the bearing points results in a change in the coiling tension. The change in the coiling tension in coiling leads to significant losses in terms of quality.

A first solution is to equalize the free length by a dancer roller, where the dancer roller assumes a position such that the coiling tension is equalized. Such a passive equalization is often slow.

However, a dancer roller can also be actively positioned with the aid of an actuator. A rapid and simple equalization of the coiling tension is possible on account of the active equalization of the free length and optionally of the different bearing point of the coiled product on the deflection roller.

Therefore, the equalization of the coiling tension in the context of the invention is performed actively. A coiled-product accumulator is preferably set such that the capacity of the latter is set in order for the coiling tension to be equalized.

The setting of the coiling tension is preferably performed to a constant value. Depending on the application, the coiling tension can also be set to a non-constant profile.

In an exemplary manner, in the case of an angular coil body, the coiling tension in the wrapping of the respective corner can be set to a higher value. In general, the coiling tension can be based on the curvature of the coil body at the first bearing point.

The coiling tension and thus the setting of the setting unit, in particular in the form of parameters, is preferably calculated during the coiling procedure. Such a calculation during the coiling procedure is also referred to as an in-line calculation. A computer unit serves for calculating the respective setting, where the computer unit is preferably assigned to a control installation. The control installation serves to control or regulate the motors and/or the respective actuators. Time can be saved in the set-up of the coiling machine and systematic errors can be equalized via an in-line calculation of the parameters for the setting unit, in that by way of example properties of the coiled product can be taken into account in the calculation.

A coiled-product brake having an adjustable braking power is advantageous for setting the coiled product tension. The coiled product herein is directed over a deflection roller, where the deflection roller is coupled to a servomotor, where the coiling tension is adjustable by setting the rotational speed.

A coiled-product brake can be advantageously expanded by further possibilities for setting the coiling tension.

A coiled-product accumulator has a plurality of deflection rollers, where the coiled product by the plurality of deflection rollers is held in a web that in terms of length is variable. The setting of the length of the web is possible by changing the position of at least one of the deflection rollers. The length of the web of the coiled product corresponds to the capacity of the coiled-product accumulator. Changing the position of the respective deflection roller is performed by an actuator.

In order for minor variations in the coiling tension to be equalized, a coiled-product accumulator can be combined with a dancer roller.

A variable coiled-product accumulator preferably has a plurality of deflection rollers, where the spacing of the respective deflection rollers can be changed with the aid of a respective actuator.

A dancer roller can also serve for equalizing the coiling tension, when interacting with an encoder, for determining the coiling tension.

A dancer roller is a deflection roller of which the position in one direction can be set passively, or with the aid of an actuator can be set actively. An encoder preferably determines the position of the dancer roller. In conjunction with a spring construction, the encoder can be employed as a force transducer. The coiling tension can be determined directly with the aid of the encoder or of the force transducer.

In order for the coiling tension to be set with the aid of the dancer roller, the position of the dancer roller is changed such that the length between the dancer roller and the corresponding deflection rollers is changed.

In order for the coiling tension to be determined, the position of the dancer roller is determined via an encoder. When the coiling tension increases, the position of the dancer roller changes toward the corresponding deflection rollers, and vice versa. The position is detected via the encoder.

The encoder can be configured as a position encoder. The encoder is preferably configured as a force transducer. The force transducer determines the force that acts on the dancer roller and on account thereof determines the coiling tension. On account of the embodiment of the encoder as a combination of a position encoder and the force transducer, a dancer roller can be employed for setting as well as for determining the coiling tension.

A force transducer is understood to be a sensor for determining the force that acts on the coiled product. By way of example, the force transducer can be configured to determine the position of a deflection roller that is held in a position by a spring. The force transducer is thus capable of directly determining the coiling tension of the coiled product.

A regulator installation serves herein for regulating the coiling tension to a constant value or to an envisaged coiling tension.

A transducer that determines the current coiling tension preferably serves as the input to the regulator installation. The regulator installation as a further input variable preferably has the envisaged coiling tension. The envisaged coiling tension can be a constant value. The coiling tension can also be a function of the alignment of the coil body. The coiling tension herein is preferably calculated during the coiling procedure. The calculation of the settings of the actuators and/or of the rotational speeds, in particular as a function of the envisaged coiling tension, is preferably performed in-line.

The regulator installation is preferably formed as a proportional regulator (P regulator), as a proportional-integral regulator (PI regulator), or as a proportional-integral-differential regulator (PID regulator).

In one advantageous embodiment of the invention, the envisaged coiling tension is constant. The envisaged coiling tension in the case of a production of battery cells and of the coiling of capacitors is preferably kept constant. "Constant" herein is understood to mean that the coiling tension, in particular at the first bearing point, this being the bearing point of the coiled product on the coil body (that in particular has already been coiled), remains constant during the coiling procedure.

As will be discussed subsequently, the coiling tension of the coiled product is preferably set with the aid of a variable coiled-product accumulator. Here, the variable coiled-product accumulator is set such that the change in the length between the first and the second bearing point is equalized. The length of the coiled product between the first bearing point and the third bearing point is thus constant. The coiling tension is constant on account of the constant length of the coiled product between the first and the third bearing point.

The first bearing point herein refers to the bearing point of the coiled product on the coil body. Furthermore, the second bearing point refers to the bearing point of the coiled product on the deflection roller from which the coiled product is wound onto the coil body. The third bearing point can be the bearing point of the coiled product on the supply roll or of the bearing point of the coiled product on a deflection roller between the supply roll and the coiled-product accumulator.

The coiling tension is kept constant in that the spacing between the first and the third bearing point is kept constant. The spacing between the first and the second bearing point herein is referred to as the free length.

In the case of the coil body having a non-circular cross section, the spacing between the first and the second bearing point is not constant because the spacing changes with the alignment of the coil body.

The change in the spacing between the first and the second bearing point is equalized. The equalization is performed in particular by the change in the capacity of the coiled-product accumulator, and/or a change in the position of the dancer roller.

Moreover, the coiling tension can be kept constant by adapting the rotational speed of the coil body and/or the rotational speed of the supply roll. Reduction of the rotational speed of the supply roll thus leads to an increase in the coiling tension. Furthermore, a reduction in the rotational speed of the coil body typically leads to a reduction in the coiling tension.

In the case of a further advantageous embodiment of the method, the setting unit has a variable coiled-product accumulator. The setting unit is preferably configured as a variable coiled-product accumulator. The coiled-product accumulator can optionally also comprise a dancer roller.

In the present embodiment the variable coiled-product accumulator serves for setting the coiling tension. The setting of the coiling tension of the coiled product is preferably performed by a change in the capacity of the variable coiled-product accumulator.

A plurality of deflection rollers are suitable as a variable coiled-product accumulator, where the coiled product traverses the plurality of deflection rollers in a meandering manner. The position of one or of a plurality of deflection rollers can be changed in order for the capacity of the coiled-product accumulator thus constructed to be set.

The change herein can be performed by an actuator, where the actuator changes the spacing of one deflection roller or of a plurality of deflection rollers in relation to one another.

The change in the length of the free length can be equalized by changing the capacity of the coiled-product accumulator. The coiling tension can thus be kept constant.

The location of the second bearing point on the deflection roller is to be observed in particular.

The following is a simple and effective manner of keeping the coiling tension of the coiled product constant on account of the equalization of the length of the coiled product with the aid of a variable coiled-product accumulator.

The free length is calculated via three components:

The web length of the coiled product between the first and the second bearing point is referred to as the free length. Furthermore relevant is the bearing point of the coiled product on the deflection roller. Moreover, the coiled product that has already been wound onto the coil body can be considered. The free length to be equalized is computable by taking into account the three aspects.

In the case of a further advantageous embodiment of the method, the setting unit has an adjustable coiled-product brake. A coiled-product brake is preferably formed as a deflection roller that is coupled to a servomotor, where the servomotor predefines the rotational speed of the deflection roller. The coiling tension is increased when the rotational speed of the deflection roller is reduced.

The setting unit is preferably configured as an adjustable coiled-product brake. Additionally, the setting unit optionally comprises a dancer roller.

The coiled-product brake can optionally also serve for setting the coiling tension. In an exemplary manner, the coiled-product brake can be employed in combination with a coiled-product accumulator and/or the dancer roller.

In a further advantageous embodiment of the method, the coiling tension is set to the envisaged coiling tension by a regulator installation. The regulator installation has a regulator circuit. The regulator circuit is preferably configured as a P regulator, a PI regulator circuit, or as a PID regulator circuit.

A regulator installation having a regulator circuit can serve for regulating the coiling tension to a constant coiling tension or to the predefined coiling tension. The regulator installation preferably regulates the position of an actuator. The actuator serves for setting the position of the dancer roller, or for setting the capacity of the coiled-product accumulator.

In a further advantageous embodiment of the method, an encoder, in particular an encoder on a dancer roller, determines the coiling tension. The encoder is preferably configured as a force transducer and/or as a position encoder. A force transducer in the case of a dancer roller is also referred to as a strain gauge. Such an encoder provides the position determined and/or the force determined to the regulator installation, in particular to the regulator circuit, and/or to the control installation. The encoder can also determine the force directly by way of the interaction of the encoder with the coiled product.

In a further advantageous embodiment of the method, the setting unit between a bearing point of the coiled product on the supply roll and the bearing point on the coiled product on the coil body sets the length of the coiled product to a constant length. In other words, the setting unit equalizes the variation in the coiling tension by changing the free length and displacing the respective second bearing point of the coiled product on the deflection roller. The change in the free length can be measured as well as preferably calculated. The change in the free length is provided to the control installation.

The free length with the aid of geometrical correlations is preferably calculated by a continuous calculation during the coiling procedure. A calculation of the free length during the coiling procedure is referred to as an in-line calculation. The calculation of the free length is particularly advantageous because measuring errors can arise in the case of an experimental determination.

In a further advantageous embodiment of the method, the setting unit, in particular in conjunction with the coiled-product accumulator, equalizes a change in a free length. The setting unit preferably serves for setting the capacity of the coiled-product accumulator. To this end, the coiled-product accumulator has at least one deflection roller, where the setting unit changes the position of the at least one deflection roller in relation to a further deflection roller.

The capacity of the coiled-product accumulator is changed by changing the position of the deflection rollers of the coiled-product accumulator in relation to one another. In the case of such a coiled-product accumulator, the coiled product passes the coiled-product accumulator, where the coiled product in terms of the direction of propagation thereof is changed by at least one deflection roller.

In a further advantageous embodiment of the method, at least one parameter for the setting unit, in particular the position of the respective actuator, is calculated when coiling. A parameter can also be the free length. A parameter that depends on the free length and optionally on the envisaged coiling tension is the setting for the respective actuator, or another parameter for the setting unit, respectively. In the calculation, the parameter can also be compared with the at least one measured parameter.

The coiling machine comprises a receptacle device for the coil body, in particular for a coil body having a non-circular cross section. Furthermore, the supply roll for the coiled product is assigned to the coiling machine. The coiling machine can have a further receptacle device for the supply roll. Furthermore, the coiling machine advantageously comprises a setting unit. The setting unit can be configured as a coiled-product accumulator, as a coiled-product brake, or as a dancer roller. Alternatively or additionally, the setting unit can be provided for setting the respective rotational speed of the supply roll and/or of the coil body.

The coiling machine can optionally have a further dancer roller. The dancer roller can be provided for equalizing the coiling tension and/or, in conjunction with an encoder, for determining the coiling tension.

The coiled product advantageously runs from the supply roll over the optional dancer roller and/or through the setting unit. The coiled product, after passing the dancer roller and/or after passing the setting unit, is provided to the coil body via a deflection roller.

The deflection roller ahead of the coil body can be part of the setting unit. The deflection roller is advantageously disposed on a fixed position. The coiled product runs over the deflection roller, where the coiled product leaves the deflection roller at a second bearing point. The bearing point changes with the alignment of the coil body, in particular in the case of a coil body having a non-circular cross-sectional area.

The coiling machine optionally has a coiled-product brake. The coiled-product brake is provided for setting the coiling tension directly to the envisaged coiling tension.

The supply roll and/or the coil body are advantageously each coupled to one drive. The respective drive serves to rotate the coil body or the supply roll. The supply roll has a second rotational speed. The coil body has a first rotational speed. The rotational speeds are controlled or regulated by the control installation.

Setting or regulating the coiling tension is possible with the aid of the rotational speed. A reduction of the first rotational speed, in particular in relation to the second rotational speed, in most instances results in a reduction of the coiling tension. The coiling tension is preferably set by regulating the respective rotational speed.

In an exemplary manner, an oval or rectangular cross section of a coil body, in the case of a uniform speed of the coiled product, leads to a periodic variation of the coiling tension. The coiling tension herein depends on the free length. The coiling tension increases as the free length increases.

In order for the coiling tension to be reduced, the first rotational speed (of the coil body) can be reduced, a coiled-product accumulator can be reduced in terms of capacity, in particular with the aid of a setting unit or of an actuator, and/or the second rotational speed, of the supply roll, can be increased.

A control installation serves for setting the coiling tension by way of the aforementioned measures. The control installation is assigned a computer unit. The computer unit serves for calculating the respective rotational speed, for setting the respective setting unit and/or the respective actuator.

BRIEF DESCRIPTION OF THE DRAWINGS

The invention will be described and explained in more detail hereunder by means of figures. The figures in particular illustrate potential embodiments of the invention. The features shown in the figures can be combined to form new embodiments, without departing from the scope of the invention, in which.

DETAILED DESCRIPTION OF THE EXEMPLARY EMBODIMENTS

Figure 1:
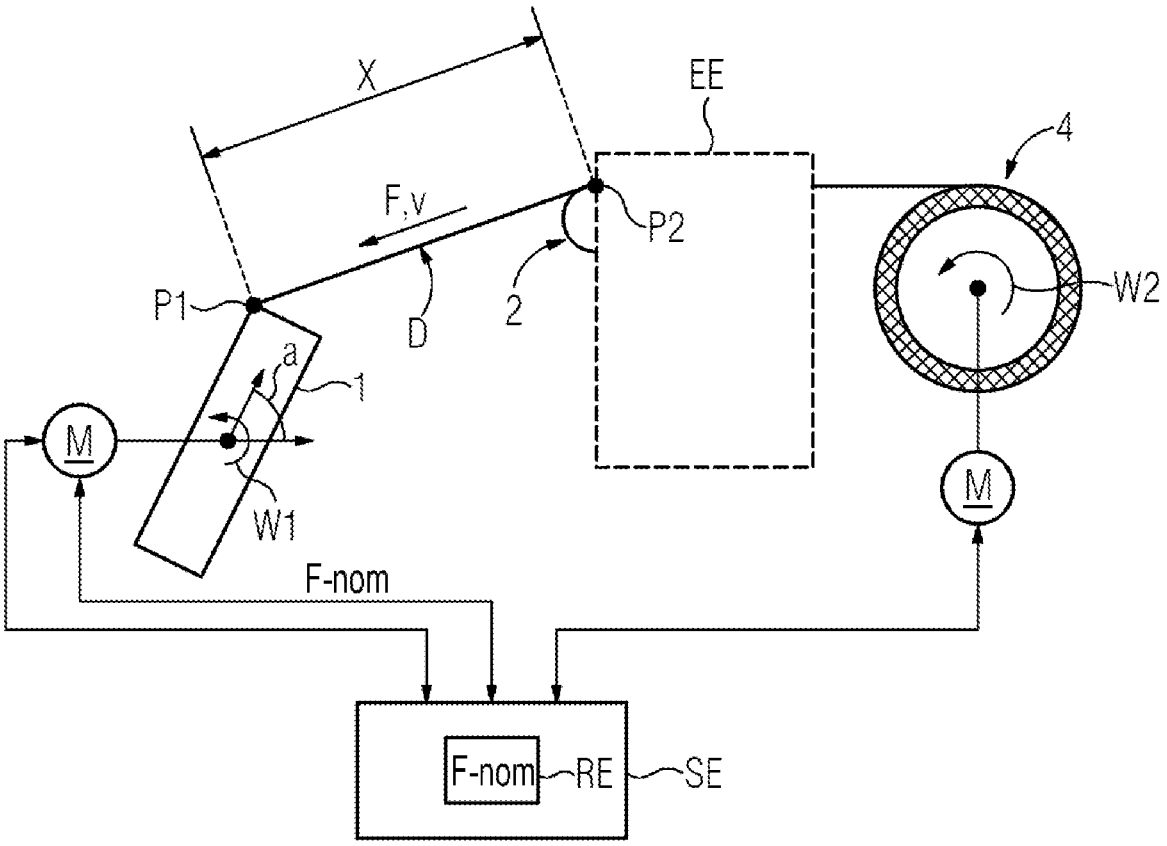
FIG. 1 shows a coiling machine.

FIG. 1 shows a coiling machine. The coiling machine has a setting unit EE. The setting unit EE can be configured as a coiled-product brake, as a coiled-product accumulator 5, and/or as a dancer roller 3. Also shown is a control installation SE, where the control installation SE comprises a computer unit RE and/or a regulating unit 9. The control installation SE serves for controlling or regulating the drive M for the coil body 1. The computer unit RE provides the envisaged coiling tension F-nom. The computer unit RE preferably provides the settings for a respective actuator 3*a*, 5*a* and/or the first and the second rotational speed W1, W2. The control installation SE, via the aforementioned variables, controls or regulates the motors M of the supply roll 4 and/or of the coil body 1. The control installation optionally controls or regulates a respective actuator 3*a*, 5*a*. The coil body in the coiling procedure rotates at a first rotational speed W1. The first rotational speed W1 corresponds to the first temporal derivation of the alignment a of the coil body 1. The coil body 1 is wrapped with the coiled product D. The coiled product D passes the coiling machine at a speed v. The coiled product D in the coiling procedure has a coiling tension F. The coiling tension F with the aid of the drive M of the coil body 1, with the aid of the drive or of the motor M for the supply roll 4, respectively, is set to an envisaged coiling tension F-nom. The supply roll has a second rotational speed W2.

The coiled product D is guided over a deflection roller 2. The coiled product D is coiled onto the coil body 1 by the deflection roller 2. The coiled product D leaves the deflection roller 2 at a second bearing point P2. The coiled product D contacts the coil body 1 at the first bearing point P1. The free length x extends between the first bearing point P1 and the second bearing point P2. The free length x corresponds to the length of the coiled product D between the deflection roller 2 and the coil body 1. The free length x periodically changes during the coiling procedure. Moreover, the second bearing point P2 on the deflection roller 2 changes in a likewise periodic manner.

Figure 2:
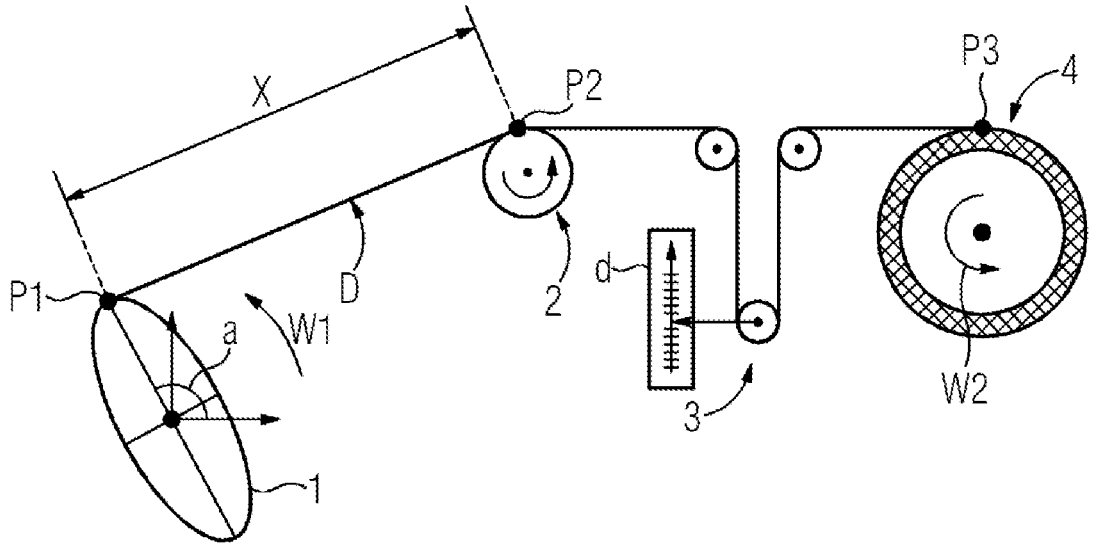
FIG. 2 shows a further coiling machine.

FIG. 2 shows a further coiling machine. The coiling machine has a dancer roller 3. The dancer roller 3 serves for equalizing the coiling tension F of the coiled product D. The coiled product D emanates from the supply roll 4 and passes the dancer roller 3. The coiled product D is coiled onto the coil body 1 via a deflection roller 2.

The dancer roller 3 is assigned an encoder and/or an actuator 3*a*. The encoder determines the position d of the dancer roller 3. The encoder can also be configured as a force transducer and can thus directly determine the coiling tension.

The change in the free length x is preferably equalized with the aid of the dancer roller 3, where the dancer roller 3 equalizes the change in the free length x with the aid of an actuator 3*a*, for example. The coiling tension F is set to a constant value on account of a constant spacing between a first bearing point P1 and a third bearing point P3. The third bearing point P3 is the point at which the coiled product D leaves the supply roll 4. The third bearing point P3 is preferably located on the supply roll 4. On account of a constant length of the coiled product between the first bearing point P1 and the third bearing point P3, the coiling tension is likewise constant.

Figure 3:
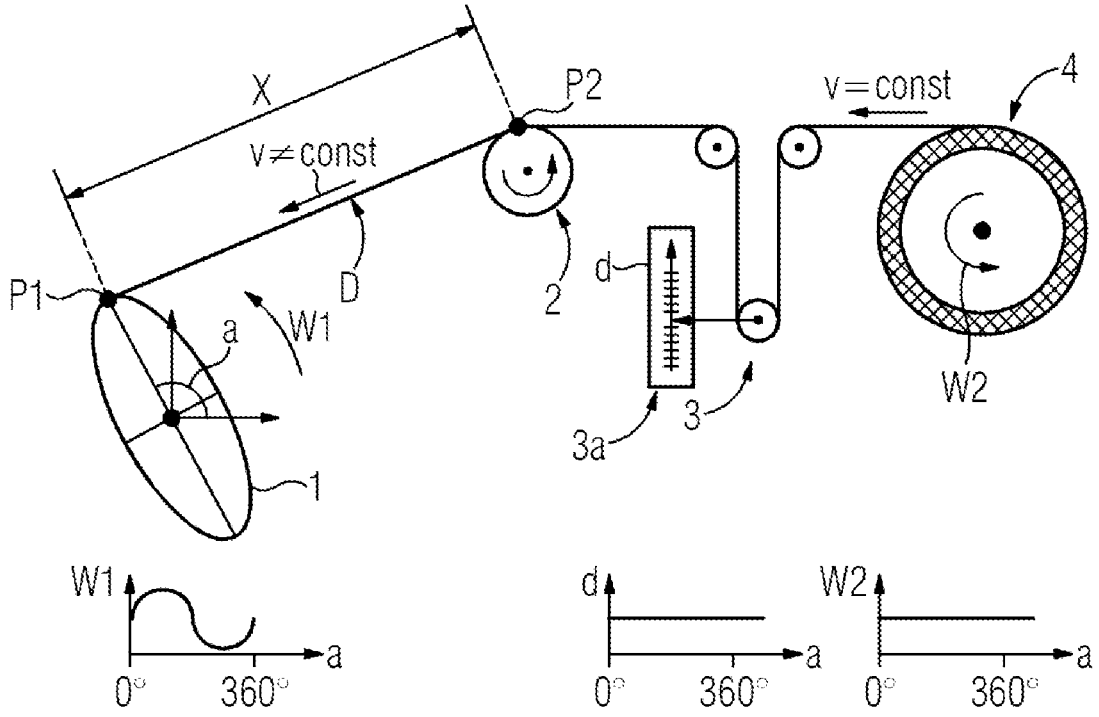
FIG. 3 shows a further coiling machine.

FIG. 3 shows a further coiling machine. The coiling machine comprises a coil body 1, a deflection roller 2, a dancer roller 3, and a supply roll 4. The speed of the coiled product D, in particular emanating from the supply roll 4, is constant. The coiled product D in the embodiment shown here runs at a constant speed v from the supply roll 4. The coiled product D passes the free length x at a non-constant speed v ($v \neq const$). The dancer roller 3 serves for equalizing the speed v of the coiled product D. The second rotational speed W2 of the supply roll 4 is constant. In particular, the second rotational speed W2 does not depend on the respective alignment a (from 0° to 360°). This means that the speed v of the coiled product D coming from the supply roll 4 is constant.

The position d of the dancer roller 3 can be actively set with the aid of the actuator 3*a*.

Furthermore, the first rotational speed W1 is not constant but has a periodic profile. This is indicated in the respective diagram. The approximately periodic profile of the first rotational speed W1, being the rotational speed of the coil body 1, is calculated via the shape of the non-circular cross section of the coil body 1. The periodic variation in the first rotational speed W1 at a constant second rotational speed W2 of the supply roll leads to an equalization of the coiling tension F of the coiled product D in the coiling procedure.

Alternatively, the supply roll 4 can also be driven at a periodic rotational speed W2. In this instance, the first rotational speed W1 can be set to a constant value.

The dancer roller 3 is optionally assigned an actuator 3*a* (not shown). Minimal variations in the coiling tension F can be equalized by the actuator 3*a* and the dancer roller.

A control installation SE (not shown) preferably serves for controlling or regulating the first rotational speed W1.

Figure 4:
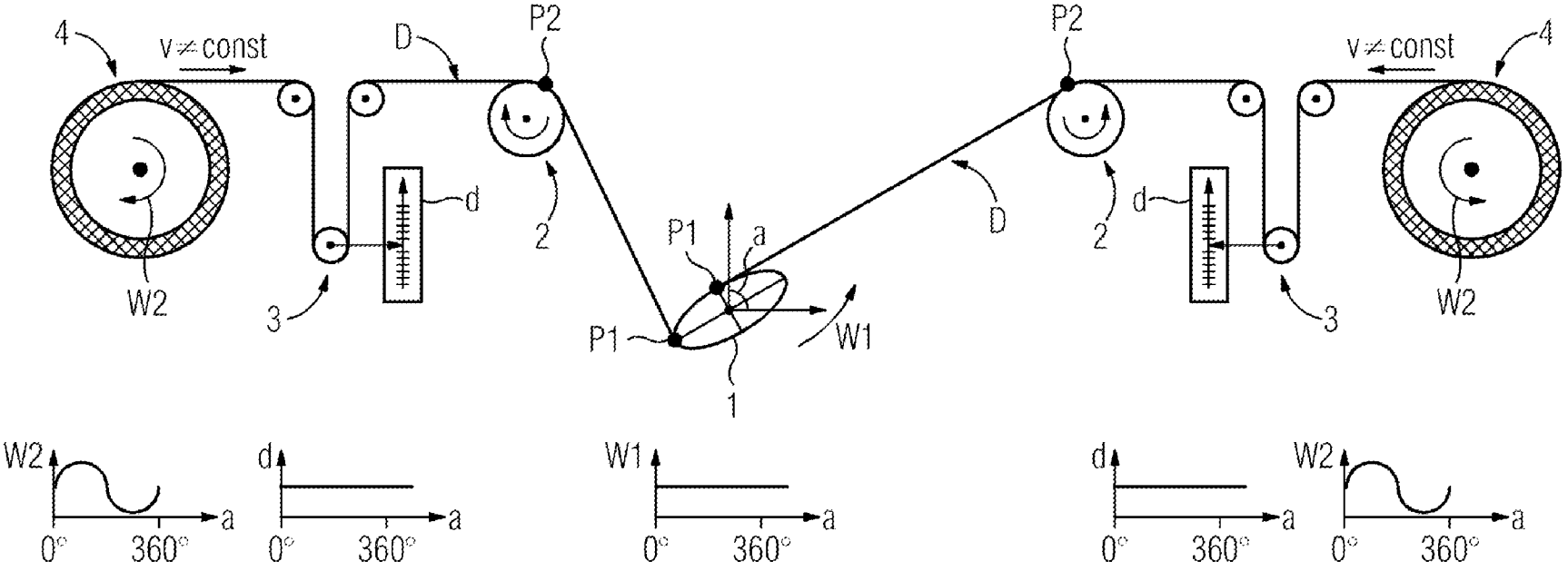
FIG. 4 shows a further coiling machine.

FIG. 4 shows a further coiling machine. The coiling machine has a coil body 1 that is coiled with two coiled products D. The first rotational speed W1 of the coil body 1 is constant.

The coiling machine has in each case one deflection roller 2. The respective coiled product D is deflected onto the coil body 1 on the respective deflection roller 2.

Moreover, one dancer roller 3 is present for each respective coiled product D. The respective dancer roller 3 is in each case assigned an encoder for determining the respective position d of the respective dancer roller 3. The position d of the respective dancer roller is almost constant. The dancer roller 3 is in each case optionally equipped with one actuator 3*a* (not shown).

In order for the respective coiling tension D of the respective coiled product D to be equalized, a variation in the respective second rotational speed W2 is performed. The variation in the coiling tension F as a function of the alignment a of the coil body 1 (or of the supply roll 4) can be set as the envisaged coiling tension F-nom.

The speed v of the respective coiled product D emanating from the supply roll 4 is not constant. The speed v of the respective coiled product D is based on the alignment a of the coil body 1.

Figure 5:
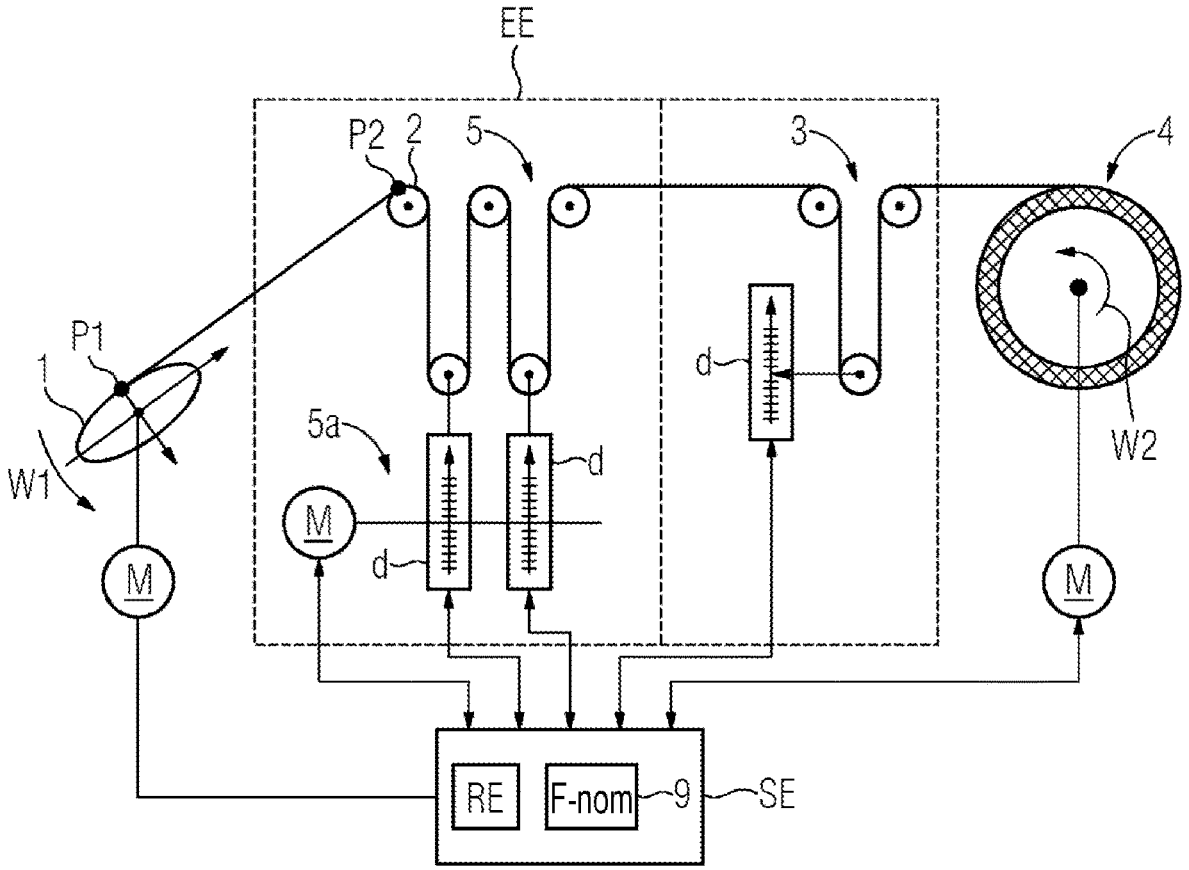
FIG. 5 shows a further coiling machine.

FIG. 5 shows a further coiling machine. The coiling machine has a coiled-product accumulator 5 and a dancer roller 3. The dancer roller 3 and/or the coiled-product accumulator 5 forms(s) the setting unit EE. The setting unit EE serves for setting the coiling tension F of the coiled product D. The "and/or" relationship is indicated by the dashed border of the respective elements 3, 5.

The coiling machine comprises a control installation SE. The control installation SE has a regulator installation 9. The regulator installation 9 serves for regulating the capacity of the coiled-product accumulator 5. The capacity of the coiled-product accumulator 5 is set via an actuator 5*a*. To this end, the actuator 5*a* changes the position d of a deflection roller of the coiled-product accumulator 5. Force transducers can furthermore determine the coiling tension F of the coiled product D.

An analogous construction of the setting unit EE can be performed via the dancer roller 3. The dancer roller 3 can be coupled to an encoder. By way of determining the position d of the dancer roller 3, the encoder determines the coiling tension F.

The coiling machine moreover comprises a control installation SE. The control installation SE comprises a computer unit RE and a regulator installation 9. The regulator installation 9 serves for regulating the position of the respective actuator 5*a* and/or of the rotational speed W1, W2.

The control installation SE furthermore has inputs for the position d of the respective dancer roller 3 and/or for the capacity of the coiled-product accumulator 5.

The control installation SE serves for setting the coiling tension to an envisaged coiling tension F, in particular to a constant envisaged coiling tension F-nom. The first and the second rotational speed W1, W2 are predefined by the control installation SE.

The rotational speeds W1, W2 are preferably constant, and the equalization of the coiling tension F is performed by the respective actuator 5*a*. The actuator 5*a* herein is set such that the free length x is equalized by the change in the capacity of the coiled-product accumulator 5.

In sum, the disclosed embodiments of the invention relate to a method for coiling a coiled product D, a control installation SE, a computer software product, and a coiling machine. The coiling tension by way of a setting unit EE and/or by way of a change in the respective rotational speed W1, W2 of a coil body 1 and/or of a supply roll 4, can be set to an envisaged coiling tension F-nom, in particular to a constant coiling tension F. A characterizing aspect is the equalization of the free length x of the coiled product, where the free length x is the spacing of the first bearing point P1 of the coiled product on the coil body 1 from the second bearing point P2 of the coiled product on a deflection roller 2. The change in the free length herein is equalized by the setting unit and/or by a variation of the respective rotational speed W1, W2. On account of the invention, the coiling tension F in the coiling of a coiled product D onto a coil body can be set in a simple, rapid, and precise manner.

Figure 6:
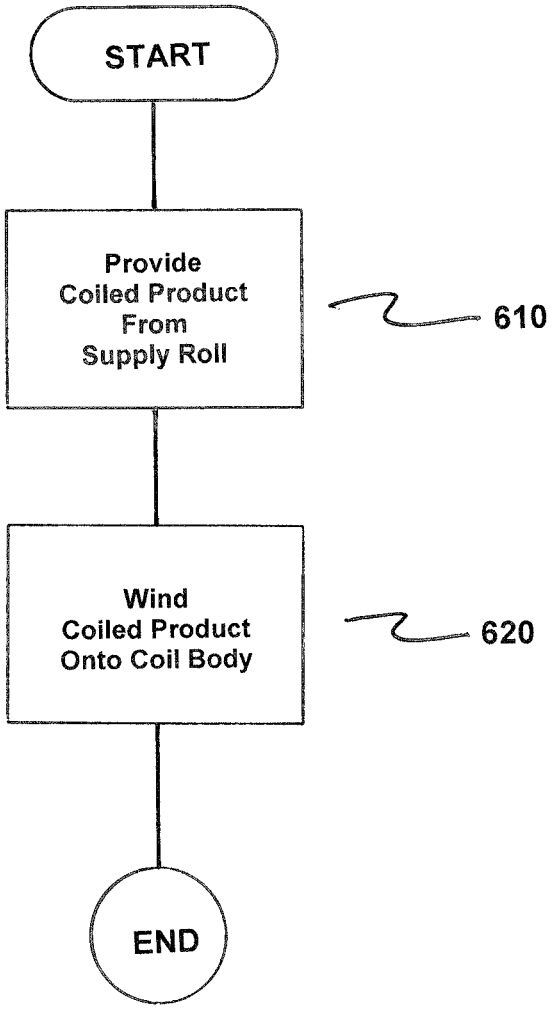
FIG. 6 is a flow chart of the method in accordance with the invention.

FIG. 6 is a flowchart of the method for coiling a coiled product D from a supply roll 4 onto the coil body 1. The method comprises providing the coiled product D from the supply roll 4, as indicated in step 610.

Next, the coiled product D is wound onto the coil body 1, as indicated in step 620. Here, the coiling tension F of the coiled product D is adjustable to an envisaged coiling tension F-nom.

In accordance with the invention, either the a rotational speed W1, W of the coil body 1 is controlled or regulated to set the coiling tension F and/or the coiling tension F is set to the envisaged coiling tension F-nom by a setting unit EE.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for coiling a coiled product from a supply roll onto the coil body, the method comprising:

providing the coiled product from the supply roll; and winding the coiled product onto the coil body, a coiling tension of the coiled product being adjustable to an envisaged coiling tension provided by a control installation including at least one of a computer unit and a regulation unit;

wherein at least one of (i) a rotational speed of the coil body is controlled or regulated to set the coiling tension and (ii) the coiling tension is set to the envisaged coiling tension by a setting unit.

2. The method as claimed in claim 1, wherein the envisaged coiling tension is constant.

3. The method as claimed in claim 2, wherein the setting unit has a variable coiled-product accumulator.

4. The method as claimed in one of claim 2, wherein the setting unit, between a third bearing point of the coiled product on the supply roll and a first bearing point of the coiled product on the coil body, sets a length of the coiled product to a constant length.

5. The method as claimed at least in claim 4, wherein the setting unit equalizes a change in a free length.

6. The method as claimed at least in claim 4, wherein the setting unit equalizes the change in the free length in conjunction with the coiled-product accumulator.

7. The method as claimed in claim 1, wherein the setting unit has a variable coiled-product accumulator.

8. The method as claimed in claim 1, wherein the setting unit has an adjustable coiled-product brake.

9. The method as claimed in claim 1, wherein the coiling tension is set to the envisaged coiling tension by a regulator installation.

10. The method as claimed in claim 1, wherein one of (i) an encoder and (ii) a force transducer determines the coiling tension.

11. The method as claimed in claim 10, wherein the encoder comprises an encoder on a dancer roller.

12. The method as claimed in claim 1, wherein at least one parameter for the setting unit is calculated when coiling.

13. The method as claimed in claim 1, wherein the at least one parameter comprises a position of an actuator.

14. The method as claimed at least in claim 1, wherein the setting of the coiling tension is performed via rotational speed of the coil body.

15. The method as claimed in claim 1, wherein the coiled product comprises wire or a film and the coil body has a non-circular cross section.

16. A non-transitory computer-readable medium encoded with a computer program executed by a computer unit that causes a coiling machine to begin coiling a coiled product from a supply roll onto a coil body, the computer program comprising:

program code for providing the coiled product from the supply roll; and program code for winding the coiled product onto the coil body, a coiling tension of the coiled product being adjustable to an envisaged coiling tension provided by a control installation including at least one of a computer unit and a regulation unit;

wherein at least one of (i) a rotational speed of the coil body is controlled or regulated to set the coiling tension and (ii) the coiling tension is set to an envisaged coiling tension by a setting unit.

17. A control installation for a coiling machine, the control installation comprising:

a control unit including at least one of a computer unit and a regulation unit;

a setting unit; and a plurality of drives;

wherein the control unit aided by at least one of (i) the plurality of drives and (ii) the setting unit is configured to:

provide a coiled product from a supply roll; and wind the coiled product onto the coil body, a coiling tension of the coiled product being adjustable to an envisaged coiling tension;

wherein at least one of (i) a rotational speed of the coil body is controlled or regulated to set the coiling tension and (ii) the coiling tension is set to the envisaged coiling tension by the setting unit.

18. A coiling machine including the control installation as claimed in the claim 17.

19. The coiling machine as claimed in claim 17, wherein the coiling machine coils wire or a film.

* * * * *